United States Patent [19]

Arad et al.

[11] Patent Number: 4,875,675

[45] Date of Patent: Oct. 24, 1989

[54] SKIPPING TOY AND METHOD OF PLAYING SAME

[75] Inventors: Avi Arad, Westport, Conn.; Melvin R. Kennedy, New York, N.Y.

[73] Assignee: Tiger Electronics, Inc., Vernon Hills, Ill.

[21] Appl. No.: 316,860

[22] Filed: Feb. 28, 1989

[51] Int. Cl.[4] ..... A63H 5/20

[52] U.S. Cl. ..... 272/74; 272/75; 446/247

[58] Field of Search ..... 272/74, 75, 128, DIG. 5; 446/26, 28, 247; 73/379, 381

[56] References Cited

U.S. PATENT DOCUMENTS

| | | | |
|---|---|---|---|
| 932,331 | 8/1909 | Russell et al. | 272/75 X |
| 1,189,307 | 7/1916 | Stokes et al. | 272/75 |
| 3,110,493 | 11/1963 | Thompson . | |
| 3,140,871 | 7/1964 | Liquori . | |
| 3,165,315 | 1/1965 | Petrusek . | |
| 3,410,554 | 11/1968 | Harrison . | |
| 3,419,269 | 12/1968 | Saffer | 272/74 |
| 3,528,654 | 9/1970 | Larson et al. . | |
| 3,589,719 | 6/1971 | Glass et al. . | |
| 4,480,831 | 11/1984 | Müller-Deinhardt | 272/DIG. 5 X |
| 4,723,775 | 2/1988 | Stephens | 272/74 X |

FOREIGN PATENT DOCUMENTS

| | | | |
|---|---|---|---|
| 1400005 | 7/1975 | United Kingdom | 272/74 UX |

*Primary Examiner*—Robert A. Hafer
*Assistant Examiner*—Sam Rimell
*Attorney, Agent, or Firm*—Dressler, Goldsmith, Shore, Sutker & Milnamow, Ltd.

[57] ABSTRACT

A toy which, during play, is rotated in a horizontal circular path about a player's ankle and automatically counts the number of successive rotations of the toy. The toy includes a collar, a drum interconnected to the collar, and a counter mechanism. The collar comfortably fits around an ankle region of a player. The drum is connected to the collar at a predetermined distance therefrom and engages a ground surface during play. During play, the drum is connected along a generally straight line to the collar in a manner imparting centrifugal rotation thereto while simultaneously permitting the drum to revolve about the straight line between the collar and drum. The counting mechanism automatically counts and provides a visual indication as to the number of successive rotations of the toy about the ankle of the player as a function of a predetermined number of drum revolutions.

12 Claims, 2 Drawing Sheets

SKIPPING TOY AND METHOD OF PLAYING SAME

FIELD OF THE INVENTION

The present invention generally relates to toys and, more particularly, to a skipping toy which, during play, is rotated in a circular path about a player's ankle and automatically counts the number of successive rotations of the toy.

BACKGROUND OF THE INVENTION

A person's ability to continuously move or rotate one hand or foot in a circular motion, such as for twirling a hoop, provides an interesting game of physical dexterity and coordination. Enjoyment of the game played normally depends on the number of repetitions a person can achieve.

As will be appreciated, a toy which can improve a player's dexterity and coordination while simultaneously providing amusement will be beneficial without becoming burdensome. The fun of playing with the toy could be increased if the number of repetitions could be automatically calculated rather than requiring the player or another to maintain a constant vigil and repetitive count.

SUMMARY OF THE INVENTION

In view of the above, and in accordance with the present invention, there is provided a toy which, during play, is rotated in a horizontal circular path about a person's ankle and automatically counts the number of successive rotations of the toy. Playing with the toy requires a player to continuously move one foot in a small generally circular motion while harmoniously moving the other foot in a generally linear direction out of the path of the toy. Successful coordination of these two movements in a skipping-like or hopping-like manner allows the toy to continually rotate in a generally horizontal circular path about an ankle region of the player. As will be appreciated, continual play with the present invention will improve both a player's dexterity and coordination.

The toy of the present invention includes a collar, a drum connected to the collar, and a mechanism for automatically counting successive rotations of the toy about the ankle of the player. The collar is adapted to fit comfortably and relatively loosely around an ankle region of the person playing with the toy. The drum is connected to the collar at a predetermined distance therefrom and engages the ground surface during play. In a preferred form, an elongated shaft interconnects the collar and drum and directs the drum in a rotary path about the ankle of the player while simultaneously permitting the drum to revolve about the longitudinal axis of the shaft during play. The counting mechanism automatically counts and visually displays the number of successive rotations of the toy about the ankle of the player as a function of a predetermined number of revolutions of the drum.

A preferred form of the present invention further includes a gear set for operating the counter mechanism in response to revoluble movement of the drum. The gear set includes a series of intermeshing gears which rotate relative to each other as the drum revolves during play. After a predetermined number of revolutions of the drum, the gear set causes the counting mechanism to index in a manner indicative of one complete rotation of the toy about the ankle of the player. By such construction, the number of successive rotations of the toy about the ankle of the player is automatically counted and recorded.

A rubber ring is preferably provided about the periphery of the drum. Such ring facilitates rotation of the drum on floor surfaces commonly found in a home, reduces the noise generated by the drum against the floor, and absorbs impact forces imparted against the drum during play.

The present invention further concerns a method of playing with the toy. When the player moves that foot having the toy attached thereto in a small circular motion, it causes the drum to engage the ground and centrifugally rotate in a predetermined circular and generally horizontal path about an ankle region of the player. The drum simultaneously revolves during its rotation as a result of engagement with a ground surface. The counting mechanism automatically counts successive rotations of the toy about the player's ankle as a function of the number of revolutions of the drum.

The method of playing with the toy further requires the player involved with playing with the toy to skip or hop in order to remove the other ankle from the circular path of the toy to complete a full rotation of the toy.

As one will readily appreciate, the ability to rotate one foot in a manner imparting circular rotation to the toy while simultaneously raising the other foot in a timely coordinated fashion allowing the toy to traverse a circular path which is generally centered about the ankle of the player is not only challenging but also improves a player's dexterity and coordination. Moreover, automatically counting the rotation of the toy about the ankle of the player adds enjoyment and a competitive nature to the toy.

Numerous other features and advantages of the present invention will become readily apparent from the following detailed description, the accompanying drawings, and the appended claims.

DETAILED DESCRIPTION OF A PREFERRED EMBODIMENT

Figure 1:
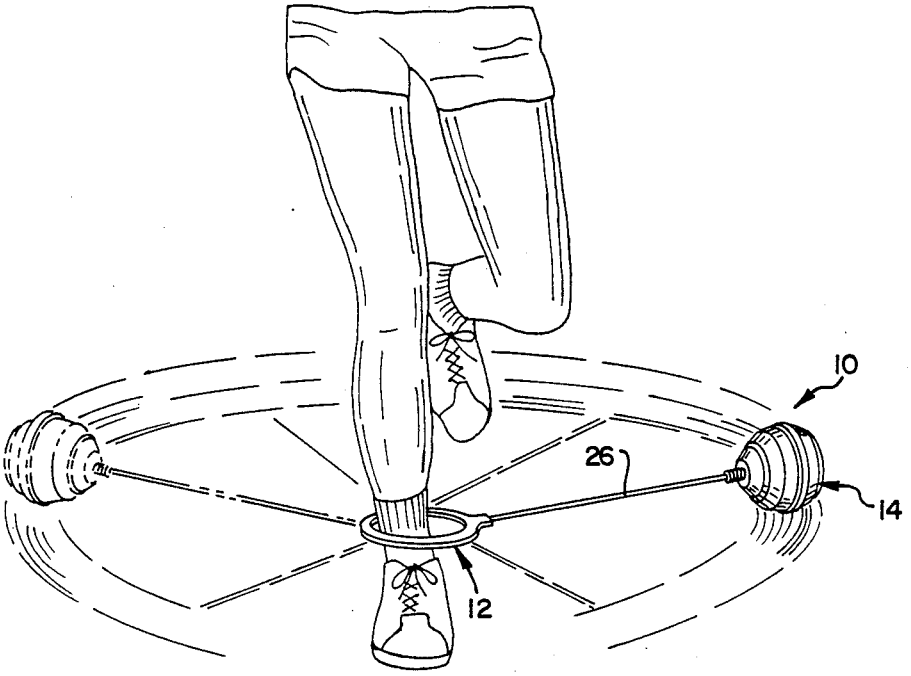
FIG. 1 is a schematic representation of a toy in play according to the present invention.

While the present invention is susceptible of embodiment in various forms, there is shown in the drawings, and will hereinafter be described, a presently preferred embodiment with the understanding that the present disclosure is to be considered as a exemplification of the invention, and is not intended to limit the invention to the specific embodiment illustrated.

Figure 2:
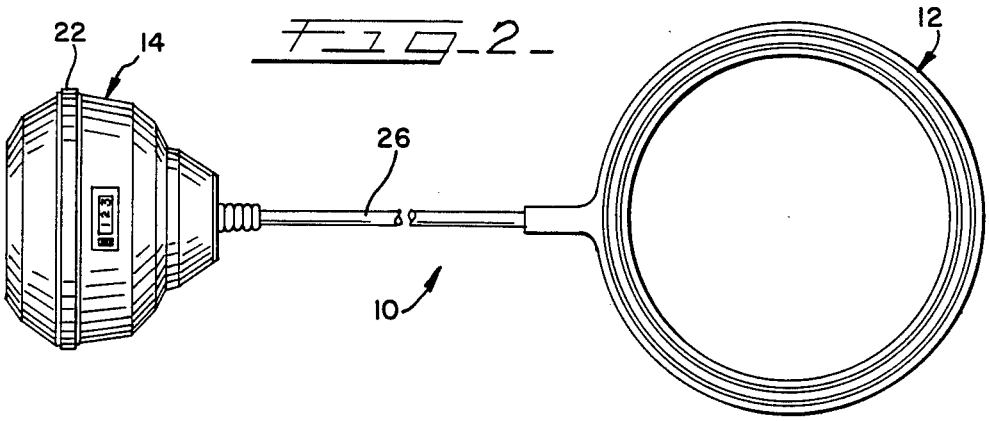
FIG. 2 is a plan view of a toy of the present invention.

Referring to FIG. 1, a toy 10 is illustrated as including a collar 12 interconnected with a drum 14. As seen in FIG. 2, collar 12 is a closed ring-like structure which preferably is formed from a suitable plastic material which lends itself to relatively inexpensive manufacturing techniques. Collar 12 is suitably sized to allow a player to insert a foot therethrough while allowing sufficient clearance about the ankle region of the player to avoid discomfort during play.

Figure 3:
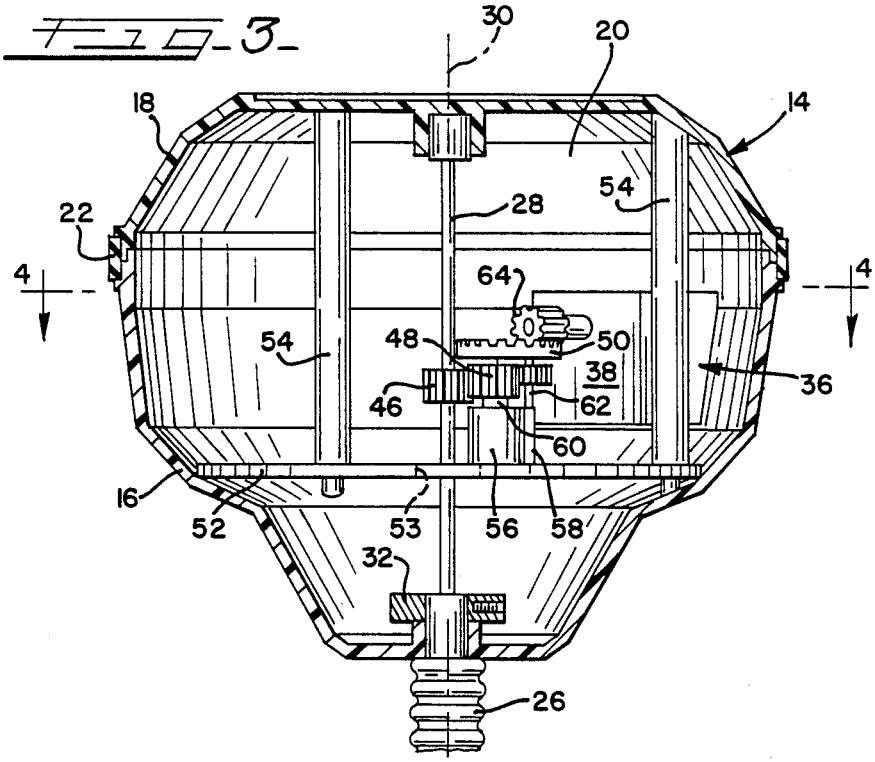
FIG. 3 is a longitudinal sectional view of a drum of the present invention.

Turning to FIG. 3, the drum 14 is preferably formed as a two-piece structure including a cup-shaped member 16 and a cover 18. When member 16 and cover 18 are interconnected, a chamber 20 is defined therebetween. Albeit hollow, drum 14 is constructed with sufficient weight as to cause it to remain in constant engagement with a ground surface during play.

In a preferred embodiment, a protective ring 22 is fixed about the periphery of the drum 14. Ring 22 is preferably formed from a resilient elastomeric material which provides a skid resistant contact surface about the periphery of drum 14.

In the illustrated embodiment, an elongated shaft 26 of a predetermined length interconnects the collar 12 with drum 14. It should be appreciated, however, that other devices (i.e., a rope, chain, bar, etc.) suitable for interconnecting the collar and drum will equally lend themselves to the present invention as long as they permit the drum 14 to revolve about an axis extending along the device interconnecting the collar 12 and drum 14.

As illustrated, one end of shaft 26 is connected to collar 12 and the other end of shaft 26 has the drum 14 revolubly secured thereto. As shown in FIG. 3, an end portion 28 of shaft 26 extends through drum 14 and defines an elongated axis 30 about which the drum revolves during play. Cover 18 preferably engages and axially locates the drum 14 on the end portion 28 of shaft 26 in a manner retarding axial movement of the drum 14 along the shaft in a first axial direction. A collar 32 is suitably affixed to the end portion 28 of shaft 26 and coacts with an internal surface of the cup-shaped member 16 to permit the drum 14 to revolve about axis 30 while simultaneously retarding movement of the drum along shaft 26 in the other axial direction.

A suitable counter mechanism 36 is arranged within the chamber 20 of drum 14 for counting the number of successive rotations of the toy about the ankle of the player as a function of a predetermined number of revolutions of the drum 14 during play. The counter mechanism 36 includes a counter 38 which provides a visual indication of the number of consecutive rotations of the toy about the ankle of the player as a function of a predetermined number of drum revolutions. A suitable opening 40 defined by drum 14 provides visual access to indicia provided on the counter 38 indicative of the number of rotations effected during play. Preferably, the counter includes a mechanism 42 which is readily accessible to the player to allow the counter 38 to be reset when desired by a player.

Figure 4:
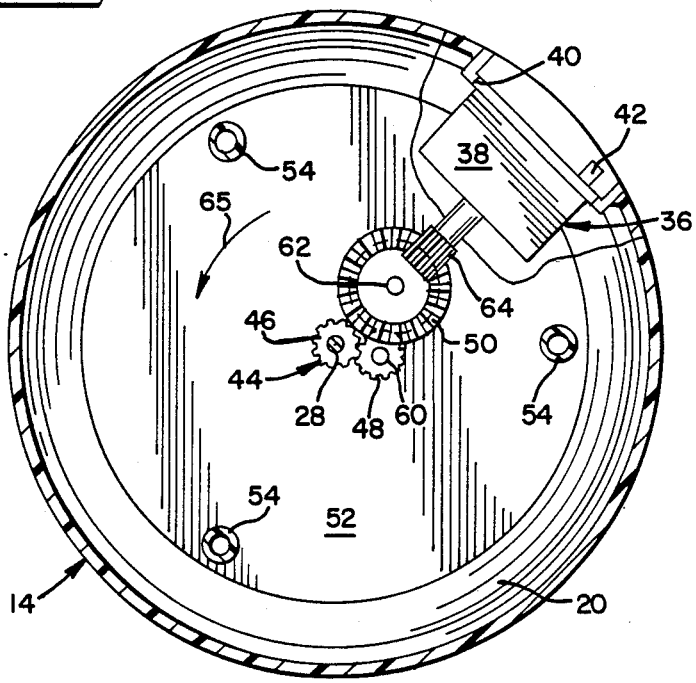
FIG. 4 is a sectional view taken along line 4—4 of FIG. 3.

FIGS. 3 and 4 schematically illustrate one form of mechanism that can be used to automatically index the counter mechanism 36 during play. As illustrated, a gear set 44, which is driven in response to revolutions of the drum 14, is used to operate the counter mechanism 36. Gear set 44 includes a series of interconnected and relatively rotatable gears including gear 46, idler gear 48, and combination gear 50.

As will be appreciated, the gear set 44 provides a specific gear reduction ratio related to the diameter of drum 14 and the effective length of toy 10. The effective length of toy 10 is generally measured by the radial distance between a location arranged within collar 12 and about which the toy rotates around an ankle portion of a player, and the ground contact location on drum 14. In the preferred embodiment, the diameter of drum 14 and the effective length of toy 10 have a ratio of about 1 to 7.

The gear set 44 is supported within chamber 20 of drum 14 on a platen 52. Drum 14 further includes mounting means for concentrically locating the platen 52 within chamber 20. The mounting means includes at least three evenly spaced standards 54 having substantially common lengths. Platen 52 is suitably secured to the free end of each standard 54. To facilitate assembly of the drum 14, platen 52 defines a generally central aperture 53 which allows gear 46 of gear set 44 to pass through the platen during assembly. Platen 52 is also provided with bosses 56 and 58 disposed at different radial distances from the center of platen 52. Bosses 56 and 58 have stub shafts 60 and 62, respectively, extending therefrom.

Gear 46 of gear set 44 is suitably secured to the end portion 28 of shaft 26. Idler gear 48 is adapted for rotation about stub shaft 60 and intermeshes with gear 46 and combination gear 50. The combination gear 50 rotates about stub shaft 62 and is adapted to drive a gear 64, which is connected to a drive shaft extending from counter mechanism 36.

To play with the toy 10, collar 12 is arranged about an ankle region of the player. The player thereafter moves that ankle with the collar arranged thereabout in a relatively small circular motion. The circular motion of the player's ankle is translated into centrifugal rotary motion of the drum 14 through the shaft 26 interconnecting the collar and drum and causes the drum 14 to rotate in a generally horizontal circular path about the ankle region of the player.

The weight of drum 14 causes the outer peripheral surface of the drum 14 to engage a ground surface and generally maintains drum 14 in contact with the ground surface during circular rotation about the ankle of the player. The circular rotation of drum 14 about the ankle of the player coupled with its contact or engagement with a ground surface, causes the drum 14 to simultaneously revolve around axis 30 of shaft 26 as, for example, in the direction of arrow 65 (FIG. 4).

As will be understood, gear 46, which is affixed to shaft 26, does not rotate as drum 14 revolves around axis 30. The revoluble motion of drum 14 in the direction of arrow 65 and about axis 30 does cause, however, stub shaft 60 to circularly rotate around gear 46 and thereby cause gear 48 to revolve about the axis of stub shaft 60. The motion of gear 48 is transferred to the counter 38 through the combination gear 50 and gear 64. A predetermined number of revolutions of the drum 14 will sufficiently rotate the gears in the gear set 44 to cause the counter mechanism 36 to index in a manner indicating one complete revolution of the toy about the ankle of the player.

The provision of ring 22 facilitates revoluble movement of the drum on polished or finished floor surfaces commonly found in a home. Moreover, the resiliency of ring 22 provides a shock absorbing effect which reduces the likelihood of drum breakage and quiets the toy when played within the house.

To enable a player to complete one complete rotation of the toy, the foot not tethered to the drum 14 must be timely removed from the rotary path of the toy as by having the player vertically lift the foot out of the circular rotary path of the toy. The player's dexterity can be measured by the number of continuous rotations of the toy about the ankle of the player. To enhance play, the counter mechanism 36 automatically maintains score of the continuous rotations of the toy. Upon completion, the player may reset the counter mechanism 36 through actuation of the reset mechanism 42.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the claims.

What is claimed is:

1. A toy adapted to be rotatably swung in a generally horizontal path about a person's ankle, said toy comprising:

a collar adapted to fit around an ankle region of the person playing with the toy;

a drum adapted to engage a ground surface during play;

elongated means for interconnecting said collar and drum, and extending along a generally straight line during play, and permitting said drum to revolve about said generally straight line while the drum contacts a ground surface, said elongated means being of predetermined length and directing said drum in a rotary path about the ankle of the player while simultaneously permitting said drum to revolve about said generally straight line and means carried by said drum for counting and visually displaying the number of successive rotations of said toy about the ankle of the player as a function of a predetermined number of revolutions of said drum about said generally straight line.

2. The toy according to claim 1 wherein said interconnecting means includes a shaft extending within and from said drum and connected to said collar in a manner permitting said drum to revolve about the longitudinal axis of such said shaft.

3. The toy according to claim 1 further including at least two members carried within the drum and which rotate relative to each other during play, one member being operably connected to said counting means and the other member being operably connected to said interconnecting means, wherein relative rotation between such members during play causes said counting means to index once for each rotation of said toy about the ankle of the player.

4. The toy according to claim 1 further including a gear set for driving said counting means in response to revoluble movement of said drum.

5. The toy according to claim 1 further including ring means fitted about said drum for facilitating revoluble movement of said drum during play.

6. A toy adapted to be rotatably swung in a generally horizontal circular path about a person's ankle, said toy comprising:

a closed collar adapted to fit around the ankle of the person playing with the toy;

a drum having a peripheral edge adapted to engage a ground surface during play;

a shaft having one end connected to said collar and having said drum revolvably secured at a predetermined distance to an opposite end of said shaft in a manner directing said drum in a rotary path about the ankle of the player during play; and counter means carried by said drum and operably interconnected with said shaft for counting and indicating the number of successive rotations of said predetermined number of revolutions of said drum about said shaft.

7. The toy according to claim 6 further including a gear set for operably interconnecting said counter means with said shaft.

8. The toy according to claim 7 wherein said gear set includes a first gear connected to said shaft, and a second gear which intermeshes with said first gear and revolves with said drum in a manner driving said counter means.

9. The toy according to claim 6 wherein the diameter of said drum at said peripheral edge and the effective radius of the circular path traversed by said drum during play have a ratio of about 1 to 7.

10. The toy according to claim 6 further including a resilient ring secured about said drum for absorbing impact forces directed against said drum during play.

11. A method of playing with a toy including a ground engaging drum flexibly secured to a collar comprising the steps of:

placing the collar on one ankle of a player;

causing said drum to centrifugally rotate in the predetermined circular and generally horizonal path about an ankle region of a player during play, said drum simultaneously revolving during its rotation in a circular path as a result of engagement with a ground surface; and automatically counting the number of successive rotations of said drum about the player's ankle as a function of the number of revolutions of said drum during play.

12. A method of playing with a toy according to claim 11 further comprising the step of:

causing said player to timely move the other ankle to which the toy is not attached out of the circular path to complete a full rotation of said toy.

* * * * *

UNITED STATES PATENT AND TRADEMARK OFFICE

CERTIFICATE OF CORRECTION

PATENT NO. : 4,875,675

DATED : October 24, 1989

INVENTOR(S) : A. Arad and M. R. Kennedy

It is certified that error appears in the above-identified patent and that said Letters Patent is hereby corrected as shown below:

Column 6, line 19, before "predetermined" insert -- toy about the ankle of the player as a function of a --.

Line 44, "a" should be -- the --.

Signed and Sealed this

Twelfth Day of February, 1991

*Attest:*

*Attesting Officer*

HARRY F. MANBECK, JR.

*Commissioner of Patents and Trademarks*